United States Patent [19]

Samchisen

[11] Patent Number: 4,834,675

[45] Date of Patent: May 30, 1989

[54] SNAP-N-SEAL COAXIAL CONNECTOR

[75] Inventor: Edward J. Samchisen, Lowman, N.Y.

[73] Assignee: LRC Electronics, Inc., Horseheads, N.Y.

[21] Appl. No.: 257,401

[22] Filed: Oct. 13, 1988

[51] Int. Cl.[4] ..... H01R 17/18

[52] U.S. Cl. ..... 439/578; 439/589; 29/857

[58] Field of Search ..... 439/587, 589, 578, 585, 439/271–277, 283; 29/747, 857, 876, 881

[56] References Cited

U.S. PATENT DOCUMENTS

| | | | |
|---|---|---|---|
| 3,406,373 | 10/1968 | Forney, Jr. | 439/675 |
| 4,280,749 | 7/1981 | Hemmer | 439/578 |
| 4,593,964 | 6/1986 | Forney, Jr. et al. | 439/585 |
| 4,600,263 | 7/1986 | De Champ et al. | 439/585 |

FOREIGN PATENT DOCUMENTS

| | | | |
|---|---|---|---|
| 1191880 | 4/1965 | Fed. Rep. of Germany | 439/578 |
| 3211008 | 10/1983 | Fed. Rep. of Germany | 439/578 |
| 1087228 | 10/1967 | United Kingdom | 439/583 |
| 1270846 | 4/1972 | United Kingdom | 439/578 |

*Primary Examiner*—David Pirlot
*Attorney, Agent, or Firm*—Weingarten, Schurgin, Gagnebin & Hayes

[57] ABSTRACT

A snap-n-seal connector for coaxial cables includes a connector body, an annular compression sleeve and optionally, a sealing nut. The connector body includes an annular collar member which peripherally engages the jacket of a coaxial cable, a post member coaxially disposed within the annular collar member to engage the dielectric insulation and the braided shield of the coaxial cable, and a rotatable nut member disposed in combination with the collar and post members. The connector body further includes a sealing member disposed between the collar and nut members to form a moisture-proof seal therebetween and an annular contact spring member seated within the collar member and circumferentially disposed about the post member to engage the braided shield of the coaxial cable. The compression sleeve is configured for snap fitting engagement between the jacket of the coaxial cable and the annular collar member to provide a moisture proof circular seal therebetween and to force the braided shield into mechanical and electrical engagement with the contact spring member. The compression sleeve includes a sealing member to provide a 360 degree moisture proof seal between the compression sleeve and the collar member. The sealing nut includes a sealing member and is threaded onto an interface connector to provide a moisture proof seal between the interface connector and the nut member.

7 Claims, 5 Drawing Sheets

SNAP-N-SEAL COAXIAL CONNECTOR

FIELD OF THE INVENTION

The present invention relates generally to connectors for coaxial cables, and more particularly, to a snap-n-seal connector for coaxial cables.

BACKGROUND OF THE INVENTION

Coaxial cable connectors are well known in the art. The F-type coaxial cable connectors are typically threaded onto a complimentary interface connector to electrically integrate coaxial cables to various electronic devices such as TVs, CBs, FM radios, and amateur radio systems.

There are several disadvantages with prior art coaxial cable connectors. A primary function of coaxial connectors is to ensure good engagement between the shield element of the coaxial cable and the connector body for electrical signal transmission. A problem with prior art coaxial connectors involves moisture infiltration into the connector body, between the connector body and the coaxial cable, and between the connector body and the interface connector. Another problem is the ease with which the coaxial connector is integrated to the coaxial cable. An FJS series connector as illustrated in FIG. 1 is a representative example of a prior art coaxial cable connector. The FJS coaxial cable connector 100 comprises a connector body 102 which includes an annular collar member 104, a post member 106 coaxially disposed within the collar member 104, and a nut member 108 circumferentially disposed about the post member 106. The connector 100 also includes a jacket seal 110 disposed about the inner periphery of the collar member 104 and a face seal 112 intermediately disposed between the outer surface of the post member 106 and the inner surface of the nut member 108.

The connector 100 is combined with the coaxial cable by inserting the free end thereof into the end 114 of the connector body 102 such that the dielectric insulator and center conductor of the coaxial cable lie within the post member 106. The braided shield and the jacket of the coaxial cable are disposed intermediate the outer surface of the post member 106 and the inner surface of the collar member 102. The jacket seal 110 confronts the jacket of the coaxial cable. A hexagonal crimping tool is utilized to apply a compression force to the end 114 of the collar member 104 to force the jacket seal 110 into sealing engagement with the jacket of the coaxial cable.

There are several inherent problems in combining a coaxial cable with an FJS series connector. First, the hexagonal crimping tool does not apply a uniform compression force on the outer surface of the annular collar member 104. Rather, the hex crimp leaves several uncompressed or partially compressed zones between the jacket seal 110 and the coaxial cable jacket. These zones are possible avenues of moisture infiltration, exemplary illustrated by arrow 120, between the jacket and the inner surface of the collar member 104. Infiltrated moisture 120 may eventually contact the braided shield and degrade the signal transmission performance of the connector.

Secondly, for coaxial cables having high braid percentages, the insertion of the coaxial cable into the connector body 102 may cause the jacket seal 110 and/or the braided shield to be damaged and/or misorientated. This may result in degraded electrical signal transmission performance and/or a degradation in the moisture seal.

In addition, the variety of coaxial cable sizes requires the availability of three different sized hex crimp tools to ensure that a sufficient compression force may be applied to the collar member 104. There is an extra cost associated with multiple crimp tools and inconvenience in carrying extra tools.

Moisture infiltration may also occur in the area between the collar member 104 and the nut member 108, as indicated by arrow 122, since there is no sealing element therebetween. This may cause oxidation bonding of the nut member 108, thereby precluding the free rotation thereof necessary for hookups.

Finally, moisture infiltration may occur at the interface end 116 of the connector body 102 since the face seal 112 is a recessed seal. Moisture infiltration 124 between the interface connector and the nut member 108 may be precluded by disposing a rubber boot about the junction. This solution, however, requires the installation of an additional element with the associated cost and time considerations.

SUMMARY OF THE INVENTION

The snap-n-seal connector of the present invention overcomes the inherent limitations of prior art coaxial connectors as well as providing extra protection against moisture infiltration. The connector of the present invention provides a uniform 360° compression moisture seal between the connector and the jacket of the coaxial cable, provides an additional moisture seal between elements of the connector body, and provides another moisture seal between the connector and an interface connector. The snap-n-seal connector also ensures good metal-to-metal contact between the braided shield of the coaxial cable and the connector. Further, the snap-n-seal connector requires only one installation tool to integrate the connector to differing sizes of coaxial cables, thereby eliminating the need for a variety of hex crimp tools. Moreover, the snap-n-seal connector may be used with coaxial cables having a wide range of braided shield percentages. This is accomplished by applying a continuous motion to the compression sleeve until an integral positive stop is achieved.

The snap-n-seal connector of the present invention includes a connector body, an annular compression sleeve and, optionally, a sealing nut. The connector body includes an annular collar member which peripherally engages the jacket of the coaxial cable, a post member disposed in coaxial combination with the collar member to engage the dielectric insulation and the braided shield of the cable, and a rotatable annular nut member disposed in combination with the collar and nut members.

The connector body further includes an annular contact spring member seated within the collar member and circumferentially disposed about the post member. The spring member includes a plurality of depending fingers adapted to engage the braided shield of the coaxial cable. The connector body also includes a sealing member disposed between the collar and nut members.

The annular compression sleeve is configured to snap fit into the collar member to provide a compression seal between the jacket of the cable and the inner surface of the collar member. The compression sleeve includes a sealing member to provide a 360 degree moisture-proof seal between the sleeve and the collar member. The sleeve also includes an attachment ring so that the sleeve may be packaged with the connector body.

The coaxial cable is readily stripped for insertion into the connector body by means of a special preparation-/installation tool. The compression sleeve is readily pushed along the cable and inserted into the collar member with a constant applied force for snap-fit engagement therebetween. The insertion force may be applied using the special installation tool.

The insertion force exerted on the compression sleeve causes the braided jacket to be compressed onto the post member and into mechanical and electrical engagement with fingers of the spring member. The insertion force also causes the sleeve sealing member to be compressed between the sleeve and collar members to provide a 360 degree moisture seal. A compressive seal is also formed between the cable jacket and the sleeve member.

The nut member is rotated for threading onto an interface connector to integrate the snap-n-seal connector and coaxial cable combination to an electronic device. The optional sealing nut may be threaded onto the interface connector and counterrotated into engagement with the nut member. The sealing nut includes a sealing member which is compressed to provide a moisture barrier. In addition, the compression of the O-ring exerts a locking force between the nut member and sealing nut which prevents inadvertent disengagement therebetween.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
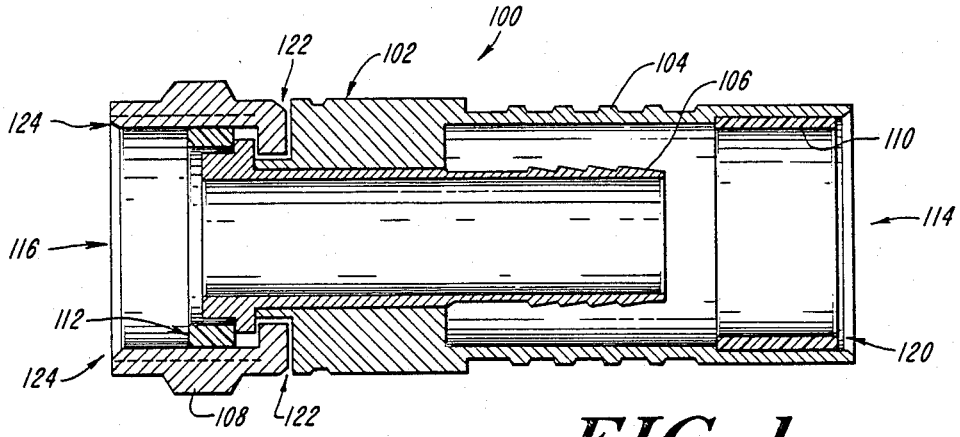
FIG. 1 (PRIOR ART)
FIG. 1 illustrates a prior art FJS series connector.
Figure 2A:
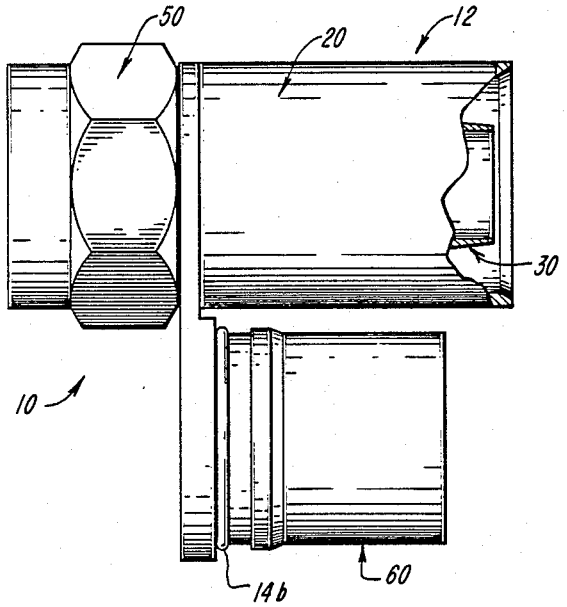
FIGS. 2A, 2B are partial and full cross-sectional views of elements of a snap-n-seal connector according to the present invention.
Figure 2B:
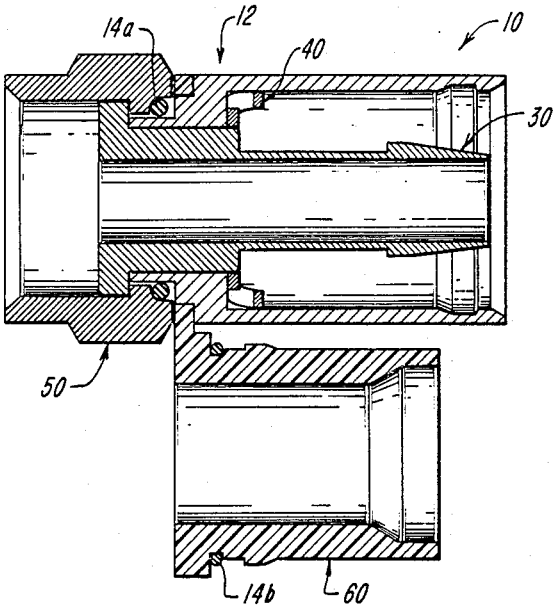

Referring now to the drawings wherein like reference numerals designate corresponding or similar elements throughout the several views, there is shown in FIGS. 2A, 2B partial and full cross-sectional views of a snap-n-seal connector 10 for a coaxial cable 80 (see FIGS. (9A–9H) according to the present invention. The connector 10 includes a connector body 12, a compression sleeve 60 and an optional sealing nut 16. The connector body 12 includes an annular collar member 20, an annular post member 30, an annular contact spring member 40, an annular nut member 50 and an annular sealing member 14*a*.

Figure 3:
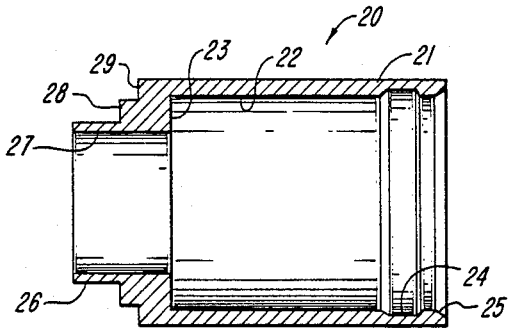
FIG. 3 is a cross-sectional view of an annular collar member for a snap-n-seal connector according to the present invention.

An exemplary annular collar member 20 is shown in cross-sectional view in FIG. 3. The collar member 20 may fabricated from a metal such as brass and may be plated with a metal such as cadmium. The collar member 20 may have a coating such as chromate overlying the cadmium plating. The exemplary collar member 20 of FIG. 3 has an overall length of approximately 0.69 inches and an outer diameter of approximately 7/16 inches.

The collar member 20 is fabricated to have a first tubular end portion 21 and a second tubular end portion 26. The first tubular end portion 21 defines a bore 22 having a diameter sized to receive the free end of the coaxial cable and the compression sleeve 60. By way of example only, the diameter of the bore 22 may be approximately 0.383 inches.

The bore 22 of the first tubular end portion 21 terminates internally in an annular flat bottom 23. An annular groove 24 is formed in the first tubular end portion 21 near the end thereof as illustrated in FIG. 3. The end of the first tubular end portion 21 may have a taper 25 to facilitate insertion of the compression sleeve 60 into the bore 22.

The second tubular end portion 26 defines a bore 27 having a diameter sized to receive the post member 30. By way of example only, the diameter of the bore 27 may be about 0.255 inches. The second tubular end portion 26 is formed to have first and second annular shoulder portions 28, 29 as shown in FIG. 3.

Figure 4:
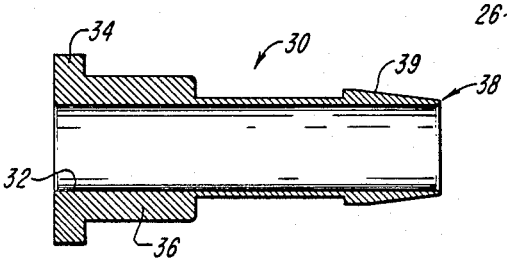
FIG. 4 is a cross-sectional view of an annular post member for a snap-n-seal connector according to the present invention.

An exemplary post member 30 is illustrated in cross section in FIG. 4. The post member 30 may fabricated from a metal such as brass and may be plated with a metal such as cadmium. The post member 30 may have a coating such as chromate overlying the cadmium plating. The exemplary post member 30 of FIG. 4 has an overall length of approximately 0.71 inches and a maximum outer diameter of approximately 0.337 inches.

Figure 9A:
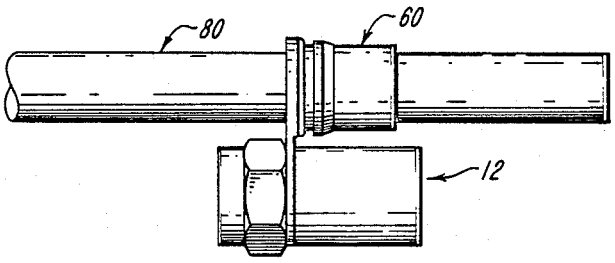
FIGS. 9A–9H illustrate exemplary steps for installing a snap-n-seal connector according to the present invention onto a coaxial cable.
Figure 9B:
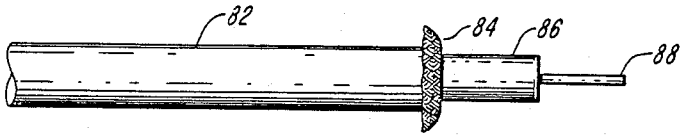

The post member 30 has a bore 32 formed therethrough, the bore 32 having a diameter sized to receive the center conductor 88 and dielectric insulation 86 of the coaxial cable 80 (see FIG. 9B). By way of example only, the diameter of the bore 32 may be approximately 0.154 inches.

The post member 30 is fabricated to have a flanged end portion 34, an interfacing portion 36 and a projecting tubular end portion 38. The interfacing portion 36 is sized to fit within the bore 27 of the second tubular end portion 26 of the collar member 20. The projecting tubular end portion 38 is coaxially disposed within the bore 22 of the first tubular end portion 21 of the collar member 20. The end of the projecting tubular end portion 38 may be formed as a ramp 39.

Figure 5A:
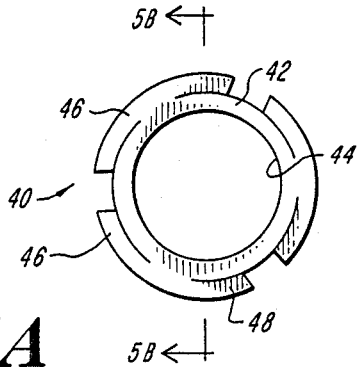
FIGS. 5A, 5B are plan and cross-sectional views of an annular contact spring member for a snap-n-seal connector according to the present invention.
Figure 5B:
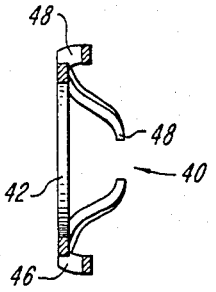

An exemplary annular contact spring member 40 is depicted in FIGS. 5A, 5B. The spring member 40 may fabricated from a metal such as spring steel (ASTM-A-684) and may be plated with a conductive metal such as silver. The contact spring member 40 of FIG. 5A has an outer diameter of approximately 0.372 inches.

The spring member 40 includes an inner annular portion 42 defining a bore 44 having a diameter such that the spring member 40 may be peripherally disposed in force-fit engagement about interfacing portion 36 of the post member 30. The spring member 40 further includes a plurality of segmented outer arcuate portions 46 integrally formed with the inner annular portion 42. As exemplarily illustrated in FIG. 5A, three outer arcuate portions 46 are formed to be equally spaced about the inner annular portion 42.

The ends of each outer arcuate portion 46 are bent outwardly from the plane of the inner annular portion 42 to form resilient fingers 48 as illustrated in FIG. 5B. The fingers 48 depend outwardly from the plane of the inner annular portion 42 a predetermined distance for mechanical and electrical engagement with the braided shield 84 of the coaxial cable 80 (see FIG. 9B). By way of example only, the predetermined distance for the fingers of FIG. 5B is about 0.115 inches. The fingers 48 should be capable of experiencing a number of compression cycles without experiencing stress fractures at the base of the fingers 48.

Figure 6:
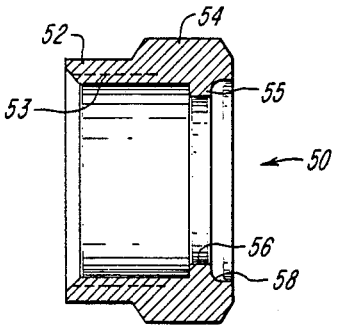
FIG. 6 is a cross-sectional view of a nut member for a snap-n-seal connector according to the present invention.

An exemplary nut member 50 is illustrated in cross section in FIG. 6. The nut member 50 may fabricated from a metal such as brass and may be plated with a metal such as cadmium. The nut member 50 may have a coating such as chromate overlying the cadmium plating. The exemplary nut member 50 of FIG. 6 has an overall length of approximately 0.308 inches and an outer diameter of approximately 7/16 inches.

The nut member 50 includes an annular end portion 52 and a hexagonal body portion 54. The annular end portion 52 includes a threaded bore 53. The threaded bore 53 is adapted to receive a threaded interface connector 92 to electrically integrate the snap-n-seal connector 10—coaxial cable combination to an electronic device 90 (see FIG. 9H).

The hexagonal body portion 54 includes an internal annular ridge 55 defining a secondary bore 56 sized to engage the outer periphery of the second tubular end portion 26 of the collar member 20. An annular arcuate shoulder 58 is formed in the body portion 54 adjacent the annular ridge 55 as shown in FIG. 6. The annular arcuate shoulder 58 is sized to receive a sealing member **14*a***, discussed in further detail hereinbelow.

Figure 7:
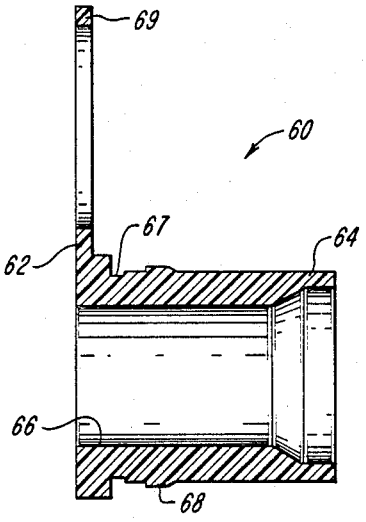
FIG. 7 is a cross-sectional view of a compression sleeve member for a snap-n-seal connector according to the present invention.

An exemplary annular compression sleeve 60 is illustrated in FIG. 7. The compression sleeve 60 is preferably fabricated from a synthetic resinous plastic. Acetal resins such as a linear polyoxymethylene-type acetal resin marketed under the Trademark DELRIN (E. I. Du Pont de Nemours and Co.) may be used to fabricate the compression sleeve 60. The compression sleeve 60 may be coated with a synthetic lubricant such as MOLYKOTE (Trademark of Dow Corning Corp.). The exemplary compression sleeve 60 of FIG. 7 has an overall length of approximately 0.480 inches and an outer diameter of approximately 0.437 inches.

The compression sleeve 60 has a flanged end 62, a tapered end 64 and an inner bore 66 sized to receive the coaxial cable 80. By way of example only, the diameter of the inner bore 66 may be approximately 0.253 inches. An annular groove 67, sized to retain an annular sealing member **14*b*, is formed adjacent the flanged end 62. A ramped annular ridge 68 is formed about the outer periphery of the compression sleeve 60 as shown in FIG. 7**.

The compression sleeve 60 further includes an annular attachment ring 69 integrally formed with the flanged end 62. The attachment ring 69 is sized to fit within the second shoulder portion 29 of the collar member 20. Thus, the attachment ring 69 permits the compression sleeve 60 to be packaged in combination with the connector body 12 which greatly facilitates the process of installing the snap-n-seal connector 10 on the coaxial cable 80.

Figure 8:
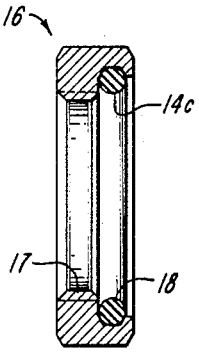
FIG. 8 is a cross-sectional view of a sealing nut for a snap-n-seal connector according to the present invention.

An exemplary annular sealing nut 16 is illustrated in FIG. 8. The sealing nut 16 may be fabricated from a metal such as brass and may be plated with a metal such as cadmium. The sealing nut 16 includes a threaded bore 17 which is adapted to be threaded onto the threaded interface connector 92. The sealing nut 16 further includes an arcuate shoulder 18 sized to receive an sealing member **14*c***.

Sealing members **14*a*, 14*b*, 14*c* are used in combination with the connector body 12, the compression sleeve 60 and the sealing nut 16, respectively, as illustrated in FIGS. 2A, 2B and 8. The sealing member 14*a*, 14*b*, 14*c*** are formed as O-rings from synthetic rubbers or elastomers such as neoprene.

The snap-n-seal connector 10 is assembled by first inserting the sealing member **14*b* in the annular groove 67 of the compression sleeve 60 and installing the sealing member 14*a* against the first shoulder portion 26 of the collar member 20. The contact spring member 40 is inserted in the bore 22 of the collar member 20 flush against flat bottom 23 with the fingers 48** thereof depending outwardly therefrom.

The attachment ring 69 is then installed against the second shoulder portion 29 of the collar member 20. The sealing member **14*a* may then be lubricated with a silicone-type lubricant and the nut member 50 placed in abutting engagement with the collar member 20 such that the sealing member 14*a* is disposed within the arcuate shoulder 58 of the nut member 50 to form a moisture-proof seal therebetween. The post member 30 is then coaxially inserted through nut member 50 into the collar member 20** and press fitted into position.

The interfacing portion 36 of the post member 30 is mechanically engaged within the bore 27 of the collar member 20. The contact spring member 40 is securely engaged on the interfacing portion 36. The flanged end portion 34 of the post member 30 abuts the annular ridge 55 of the nut member 50 and the second tubular end portion 26 of the collar member 20. In the assembled configuration, the compression sleeve 60 and the nut member 50 are freely rotatable.

An exemplary method for installing the assembled snap-n-seal connector 10 to the coaxial cable 80 is illustrated in FIGS. 9A–9H. The first step is to slide the compression sleeve 60 onto the coaxial cable 80 as shown in FIG. 9A. The free end of the coaxial cable 80 is prepared by removing a portion of the cable jacket 82 and folding the braided shield 84 back to expose the dielectric insulation 86 and the center conductor 88 as shown in FIG. 9B. A specially designed preparation/installation tool, described and claimed in the copending related application filed concurrently with this application, entitled A PREPARATION/INSTALLATION TOOL FOR SNAP-N-SEAL CONNECTORS, may be used to prepare the free end of the cable 80.

Figure 9C:
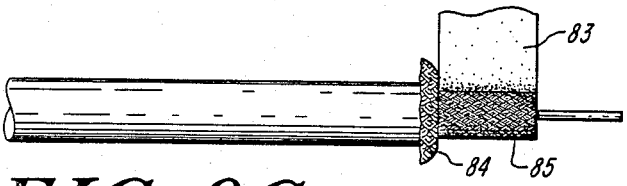
Figure 9D:
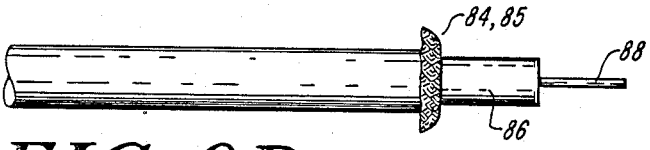

For QS-type coaxial cables, the cable must be further prepared as shown in FIGS. 9C–9D. The foil 83 intermediate the outer and inner braided shields 84, 85 is scored and removed as shown in FIG. 9C. The inner braided shield 85 is then folded back into the outer braided shield 84 as shown in FIG. 9D.

Figure 9E:
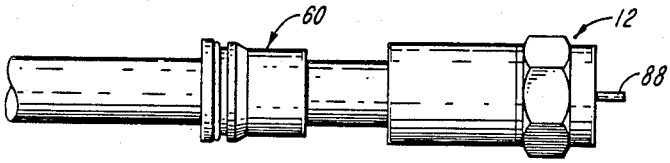

After the free end of the cable 80 has been prepared, the connector body 12 is separated from the compression sleeve 60. The free end of the cable 80 is inserted into the collar member 20 until the end of the dielectric insulation 86 is flush with the flanged end portion 34 of the post member 30 as illustrated in FIG. 9E. During insertion, the projecting tubular end portion 38 of the post member 30 is urged intermediate the braided shield 84 and dielectric insulation 86 of the unprepared cable 80.

Figure 9F:
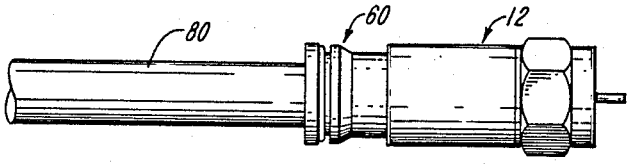
Figure 9G:
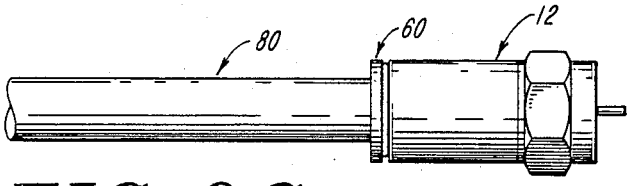

The compression sleeve 60 is then pushed into the collar member 20 of the connector body 12 as shown in FIG. 9F. An insertion force is applied to snap the compression sleeve 60 into final engagement with the connector body 12, as shown in FIG. 9G, such that the ramped annular ridge 68 of the compression sleeve 60 is disposed in the annular groove 24 of the collar member 20. The insertion force may be applied by means of the preparation/installation tool described and claimed in the copending related application filed concurrently with this application, entitled A PREPARATION/INSTALLATION TOOL FOR SNAP-N-SEAL CONNECTORS. Due to the relative sizing between the coaxial cable 80 and the compression sleeve 60, a moisture seal is formed between the cable jacket 82 and the inner bore 66 of the compression sleeve 60 due to compressive forces therebetween.

The sealing member **14*b* is sealingly compressed between the first tubular end portion 21 of the collar member 20 and the flanged end 62 of the compression sleeve 60. The sealing member 14*b* provides a 360 degree moisture-proof seal between the compression sleeve 60 and the connector body 12**.

As the compression sleeve 60 is pushed into the collar member 20, the sleeve 60 forces the braided shield 84 onto the projecting tubular end portion 38 of the post member 30. In the final snap-engaged position, the tapered end 64 of the compression sleeve 60 urges the braided shield 84 into mechanical and electrical engagement with the fingers 48 of the contact spring member 40 to ensure a positive electrical connection.

Figure 9H:
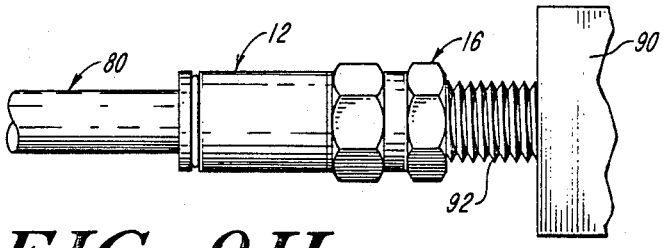

As depicted in FIG. 9H, the snap-n-seal connector 10 is used to interconnect the coaxial cable 80 to an electronic device 90. The nut member 50 is rotated to thread the threaded interface connector 92 into the threaded bore 53 of the annular end portion 52, thereby providing electrical connection between the center conductor 88 of the coaxial cable 80 and the electronic device 90.

If the optional sealing nut 16 is utilized, it is threaded onto the threaded interface connector 92, with the sealing member **14*c* facing outwardly, prior to threading the nut member 50 onto the threaded interface connector 92. The sealing nut 16 is then counterrotated into engagement the nut member 50. The sealing member 14*c* is compressed between the sealing nut 16 and the annular end portion 52 of the nut member 50** to provide a moisture-proof seal therebetween.

A variety of modifications and variations of the present invention are possible in light of the above teachings. It is therefore to be understood that within the scope of the appended claims, the present invention may be practiced otherwise than as specifically described hereinabove.

What is claimed is:

1. A snap-n-seal coaxial connector for mechanically and electrically interconnecting a coaxial cable to an electronic device having a threaded interface connector, the coaxial cable including a center conductor, a dielectric insulator encasing the center conductor, at least one braided shield disposed about the dielectric insulator and a jacket covering the at least one braided shield, comprising:

connector body means for coaxially receiving the coaxial cable, said connector body means including means for forming a moisture-proof seal between elements of said connector body means, nut member means adapted for rotatably engaging the threaded interface connector of the electronic device, and resilient means for mechanically and electrically engaging the at least one braided shield of the coaxial cable; and compression sleeve means for snap engaging into said connector body means to mechanically connect the coaxial cable to said connector body means, said compression sleeve means in combination with said connector body means forming a 360 degree uniform compressive moisture-proof seal between said compression sleeve means and the jacket of the coaxial cable, said compression sleeve means including means for forming a 360 degree uniform compressive moisture-proof seal between said compression sleeve means and said connector body means.

2. The snap-n-seal connector of claim 1 wherein said said resilient means comprises:

an annular conductive member configured to be disposed within said conductor body means; and a plurality of segmented arcuate conductive members integrally formed with said annular conductive member, said plurality of segmented arcuate conductive members having resilient ends depending outwardly from said annular conductive member to form fingers for resiliently engaging the at least one braided shield of the coaxial cable.

3. The snap-n-seal connector of claim 1 further comprising sealing nut means configured to be rotated onto the threaded interface connector and counterrotatable on the threaded interface connector to snugly engage said nut member means of said connector body means, said sealing nut means including means for forming a compressive moisture-proof seal between said sealing nut means and said nut member means.

4. The snap-n-seal connector of claim 1 wherein said compression sleeve means further comprises means for separably attaching said compression sleeve means to said connector body means.

5. The snap-n-seal connector of claim 4 wherein said compression sleeve means comprises an annular compression sleeve formed from a resinous plastic, said annular compression sleeve having an annular groove formed therein for seating of said sealing means and further including a flanged end configured to abuttingly engage said connector body means;

a tapered end configured for insertion into said connector body means and for urging the at least one braided shield of the coaxial cable into mechanical and electrical engagement with said resilient means; and wherein said separable attaching means is an annular attachment ring integrally formed with said flanged end of a synthetic resinous plastic.

6. The snap-n-seal connector of claim 5 wherein said annular compression sleeve further includes a ramped annular ridge formed peripherally thereabout, said ramped annular ridge coacting with said connector body means to lock said compression sleeve within said connector body means.

7. A method for installing a snap-n-seal connector to a coaxial cable, the coaxial cable including a center conductor, a dielectric insulator encasing the center conductor, at least one braided shield disposed about the dielectric insulator and a jacket covering the at least one braided shield, comprising the steps of:

positioning said snap-n-seal connector including a connector body assembled in combination from a collar member, a post member, a nut member and a compression sleeve separably attached to said connector body by means of an annular attachment ring, placing said compression sleeve the coaxial cable by sliding said compression sleeve over the coaxial cable;

preparing a free end of the coaxial cable for installation in said snap-n-seal connector by removing a portion of the jacket to expose the at least one braided shield, the dielectric insulator and the center conductor and folding the at least one braided shield;

separating said connector body from said compression sleeve;

inserting the coaxial cable into said collar member to have the dielectric insulator flush with a distal end of said post member; and exerting an insertion force against said compression sleeve to cause said compression sleeve to snap into said collar member of said connector body.

* * * * *